US007942754B1

(12) United States Patent
Miller, Jr.

(10) Patent No.: US 7,942,754 B1
(45) Date of Patent: May 17, 2011

(54) GOLF GREEN FOR A PATIO

(76) Inventor: Walter L. Miller, Jr., Corry, PA (US)

( * ) Notice: Subject to any disclaimer, the term of this patent is extended or adjusted under 35 U.S.C. 154(b) by 0 days.

(21) Appl. No.: 12/555,862

(22) Filed: Sep. 9, 2009

(51) Int. Cl.
*A63B 69/36* (2006.01)

(52) U.S. Cl. ..... 473/175; 473/179

(58) Field of Classification Search ..... 473/174–189
See application file for complete search history.

(56) References Cited

U.S. PATENT DOCUMENTS

| | | | | |
|---|---|---|---|---|
| 3,567,223 | A | 3/1971 | Gentiluomo | |
| 3,643,944 | A | 2/1972 | Boyes | |
| 3,772,841 | A | 11/1973 | Barak | |
| 4,272,078 | A | 6/1981 | Vinette | |
| 5,120,063 | A | 6/1992 | Birchler | |
| 5,205,559 | A * | 4/1993 | Plopper | 473/179 |
| 5,415,397 | A | 5/1995 | Van Holt, Jr. | |
| 5,427,371 | A | 6/1995 | Huston | |
| 5,620,375 | A | 4/1997 | Frotten | |
| 6,110,053 | A | 8/2000 | Sjoblom | |
| 6,508,719 | B1 | 1/2003 | Reddick | |
| 6,626,767 | B2 | 9/2003 | Lawlyes | |
| 6,800,034 | B2 * | 10/2004 | Burkholder | 473/174 |
| 6,902,491 | B2 | 6/2005 | Barlow | |
| 2007/0099716 | A1 * | 5/2007 | Du Plessis | 473/179 |

* cited by examiner

*Primary Examiner* — Mark S Graham
(74) *Attorney, Agent, or Firm* — Wayne L. Lovercheck

(57) ABSTRACT

A golf green for a patio, deck, floor, substrate or supporting surface with access from below to cut a hole therein includes a U-shaped cup retaining structure mounted to the substrate underside adjacent the hole and into which a cup is slidably inserted and seated in alignment with the hole and the cup having a passageway into which a plug is inserted with the plug having a through hole for receiving the lower end of the golf flag staff, a plurality of ring inserts for placement within the cup to alter the cup diameter and refine golf putting practice, a cover for placement over the cup to conceal the hole so that the substrate, such as the patio, can be safely traversed, and a ball collection apparatus disposed underneath the substrate and into which balls fall by gravity for collection and eventual retrieval.

20 Claims, 11 Drawing Sheets

GOLF GREEN FOR A PATIO

FIELD OF THE INVENTION

The present invention pertains to the game of golf and golf equipment, and more particularly pertains to structure securable to an indoor or outdoor supporting surface such as a game room, deck or patio having underside access so that the game of golf and golf putting practice can occur throughout the year.

BACKGROUND OF THE INVENTION

Golf is one of the most popular sporting games played both recreationally and professionally worldwide. There are many aspects and subtleties to the game of golf that require practicing and mastery various skills and techniques. For example, there is the long game that requires driving, the intermediate game that requires the use of irons, and the short game for the putting green that requires the use and mastery of clubs referred to as putters. These are the three primary aspects to the game of golf that both amateurs and professionals seek to become proficient at and master. While the game of golf can be played year round in warm, sunny climates and regions, in climates and regions that experience winter—as well as less than optimum spring and fall weather—golf is generally restricted to the summer season. Though indoor facilities do exist in some places, most golfing aficionados don't have access to such facilities nor do they necessarily have the time to engage in such outside golf practice. Since putting is the easiest part of the golf game to simulate indoors, it is a simple matter to create makeshift putting greens that consist of nothing more than a cup laid on its side and placed at one end of a carpeted office room or game room. To better simulate putting greens requires the forming of a hole in the floor surface with some sort of cup or container placed therein for collecting the putted golf ball. More elaborate contrivances to simulate an indoor golf game, and especially for simulating golf putting, includes access to the floor from below to include a ball collection and retrieval system. Such systems can include pneumatics and electronic sensing apparatus to collect and even eject the golf balls. The prior art discloses a number of devices and systems for practicing the game of golf with an emphasis on providing some type of hole, indoors or outdoors, for accommodating the putting game.

For example, the Vinette patent (U.S. Pat. No. 4,272,078) discloses a game ball target return apparatus and method that includes an improved ball return mechanism comprising a pressurizable ball return mechanism interconnected to the hole by means of a conduit and whereupon the chamber is pressurized when the ball reaches the chamber entrance for ejecting the ball therefrom.

The Van Holt, Jr. patent (U.S. Pat. No. 5,415,397) discloses a golf hole accessory for reducing the diameter and for increasing the visibility of a conventional golf hole.

The Sjoblom patent (U.S. Pat. No. 6,110,053) discloses a golf cup insert that reduces the size of the hole of a golf cup so that the player is able to putt to a smaller hole. The golf cup insert is threadably engaged to a sleeve positioned within the hole so that the golf cup insert can be adjusted up or down within the hole.

The Reddick patent (U.S. Pat. No. 6,508,719 B1) discloses a golf cup retaining holder for artificial greens that includes a retaining tube that is positioned in the ground at a selected area of the artificial green with the retaining tube held in vertical position by an anchor plate.

The Lawyles patent (U.S. Pat. No. 6,626,767 B2) discloses an apparatus for golf putting practice that includes an insert used in floor mounted HVAC systems with the insert having at least one regulation size golf hole.

The Huston et al. patent (U.S. Pat. No. 5,427,371) discloses an indoor golf hole and installation system that includes a canister threadably engaged to a collar that is disposed within the subflooring of a room thereby allowing the canister to be vertically adjustable to accommodate carpets having different thicknesses.

The J. A. Gentiluomo patent (U.S. Pat. No. 3,567,223) discloses a golf range ball handling means that includes an inclined floor, a ball retrieving gutter, a ball return means, a ball dispensing means, and a ball elevating means.

The Frotten patent (U.S. Pat. No. 5,620,375) discloses a golf putting practice apparatus that includes a flat support plate from which a cup depends and into which the golf ball falls during putting practice.

The Boyes patent (U.S. Pat. No. 3,643,944) discloses a golf cup retaining holder that supports therein a conventional golf cup for use on greens made of artificial grass.

The Birchler et al. patent (U.S. Pat. No. 5,120,063) discloses a heater register golf cup wherein a ball retrieval basket with an attached flagpole is supported within a collecting cup that seats within an opening formed on the flat plate of a conventional in-floor air duct.

The Barlow et al. patent (U.S. Pat. No. 6,902,491 B2) discloses a floating golf ball cup insert wherein the golf ball cup insert is able to move transversely in the vertical hole while being locked in place within the hole.

The Barak et al, patent (U.S. Pat. No. 3,772,841) discloses a plug for an indoor or patio golf green and hole wherein the plug is level with the planar surface surrounding the golf ball cup and hole.

Nonetheless, despite the advantages of the prior art, there remains a need for a golf ball cup and retaining structure that can be secured to any supporting surface or substrate—indoor or outdoor—to which underside access is available so that the golf ball hole is able to extend downwardly from the supporting surface for allowing golf putting practice throughout the year, especially if the golf ball cup and retaining structure is located on an indoor surface, floor, or substrate.

SUMMARY OF THE INVENTION

The present invention comprehends a golf game usable both indoors and outdoors, and especially a golf game that can be set up indoors on any suitable substrate, floor or supporting surface which has access from beneath the substrate with such a substrates including, but not limited to, decks, patios, living rooms, game rooms, porches, etc. The golf game of the present invention provides for a golf hole formed in the substrate so that the individual can play golf year round, with an especial emphasis on the putting game, in a convenient indoor environment. In addition, when the golf green and the golf hole are not in use the golf hole can be covered up thereby allowing use of the room without the worry of someone tripping over or accidentally stepping into the golf hole.

The golf game for an indoor or outdoor substrate or floor includes a U-shaped cup retaining structure that is secured to the underside of the substrate or floor adjacent and in alignment with the golf hole. It should be noted that a golf hole would be drilled into the substrate or floor at an appropriate location with easy access for drilling the hole from below or underneath the substrate or floor. The cup retaining structure includes a pair of spaced-apart legs that straddle the golf hole and extend from a body portion with the legs being perpendicular to the body portion. Each leg includes an inwardly stepped elongated portion having substantially the same length as the respective leg with each stepped elongated portion having a ledge that upwardly faces the underside of the substrate or floor. The cup retaining structure further includes a curved bight portion formed at the area where the legs join to the body portion.

The golf game for an indoor or outdoor substrate or floor also includes a cup having a centrally located passageway and opposed slots located at its lower end with the slots located 180 degrees from each other on opposed sides of the surface of the cup and the slots being parallel to each other. The cup is slid onto the cup retaining structure by aligning the slots with the legs and the inwardly stepped elongated portions so that the cup can be slid back to the bight portion and seated on the cup retaining structure immediately beneath, and in axial alignment with, the golf ball hole cut and formed in the substrate or floor. A cylindrical plug having a centrally located through hole is placed within the passageway of the cup to receive and accommodate the lower end of the staff of a golf flag for supporting the golf flag in an upright position. The golf game also includes a plurality of ring inserts that are simply rings of different diameters each of which can be placed within the upper inner end of the cup and upon an upper annular ledge of the cup for changing the diameter of the hole by closing down the size of the hole defined at the upper end of the cup. The use of the ring inserts also correspondingly closes down the size of the hole cut in the substrate or floor. Several types or embodiments for covers are also provided for easily and quickly covering the golf hole so that the golf hole doesn't become a danger or hazard when not in use. The golf game can also be provided with a ball collection system mounted beneath the substrate or floor wherein the struck or putted golf ball is directed by gravity whereupon after one or more golf balls are putted into the golf hole for conveyance to the ball collection system, the golf balls can be retrieved therefrom.

It is an object of the present invention to provide a golf green for a patio that simulates a realistic game of golf, and especially the part of the game involving putting.

It is another object of the present invention to provide a golf green for a patio that can be set up on an indoor or outdoor substrate or supporting surface having access from beneath or from the underside of the substrate or supporting surface.

It is still another object of the present invention to provide a golf green for a patio that can be easily secured to the underside of the substrate or supporting surface and easily removed therefrom.

It is yet another object of the present invention to provide a golf green for a patio that doesn't interfere with the ability of people to walk or stand upon the floor, substrate or supporting surface when the golf green is not being used.

It is still yet another object of the present invention to provide a golf green for a patio that includes a golf ball collection structure disposed beneath the floor, substrate, or supporting surface, and from which golf balls can be easily retrieved.

Still another object of the present invention is to provide a golf green for a patio that can accommodate a flag and flagpole for the realistic simulation of a putting green.

These and other objects, features, and advantages will become apparent to those skilled in the art upon a perusal of the following detailed description read in conjunction with the accompanying drawing figures and appended claims.

DETAILED DESCRIPTION OF THE PREFERRED EMBODIMENT

Figure 1:
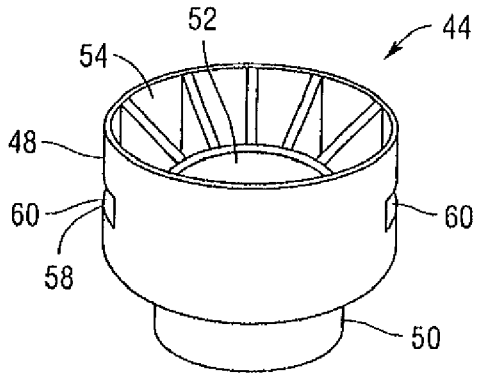
FIG. 1 is a perspective view of the golf green for a patio of the present invention illustrating the cup into which the golf ball falls during use of the golf green by the individual.

Illustrated in FIGS. 1-24 is a golf game 10 for an indoor or outdoor environment or area that allows the individual to practice and play the game of golf, and especially practice the short game or the putting game, in a realistic manner throughout the year. The golf game 10 of the present invention is especially useful for providing a realistic setting for practicing and playing the short golf game in areas, regions, or locales having winters that make outdoor golf impossible and where indoor facilities are scarce or non-existent. The golf game 10 of the present invention is utilized on any indoor or outdoor substrate, supporting surface or floor that has easy access from beneath or the underside of the substrate, supporting surface or floor. Such substrates or supporting surfaces can include, but are not limited to, decks, patios, game rooms, living rooms, entertainment rooms, etc.

Thus, as shown in FIGS. 20, 21, 23 and 24 is a substrate or supporting surface 12 that can be located indoors or outdoors and on which a golf hole 14 has been created by drilling from the underside 16 or from beneath a circular hole in the substrate or supporting surface 12 at a desired location to allow for adequate and realistic practice of the short game, i.e., the putting game. A golf flag 18 is shown projecting upwardly from the golf hole 14 with the lower end 20 of the staff or pole 22 of the golf flag 18 inserted into the golf hole 14 and supported by structure hereinafter further described. Mounted to the underside 16 of the substrate 12 is a cup retaining structure or cup holding structure 24 as shown in FIGS. 12-23. The cup retaining structure 24 is generally U-shaped and includes an upper side 26 and an underside 28. The upper side 26 is disposed contiguous to the underside 16 of the substrate 12 when the cup retaining structure 24 is mounted thereto. The cup retaining structure 24 includes a body portion 30 and a pair of spaced-apart legs 32 that are integrally formed to and extend from the body portion 30. The legs 32 are disposed parallel to each other and extend perpendicular from the body portion 30. The body portion 30 defines an inner curvilinear bight portion 34 and the spaced-apart legs 32 form an open mouth 36. Each leg 32 includes an integral elongated stepped portion 38 with each stepped portion 38 being disposed inboard or inward of the respective leg 32 to which it is integrally formed. Each stepped portion 38 defines an upwardly facing ledge 40 with each ledge 40 facing the underside 16 of the substrate 12 when the cup retaining structure 24 is mounted thereon. As shown in FIGS. 12-21 fasteners 42, such as wood or metal screws, are screwed up through the legs 32 and body portion 30 of the cup retaining structure 24 and into the underside 16 of the substrate 12.

Figure 2:
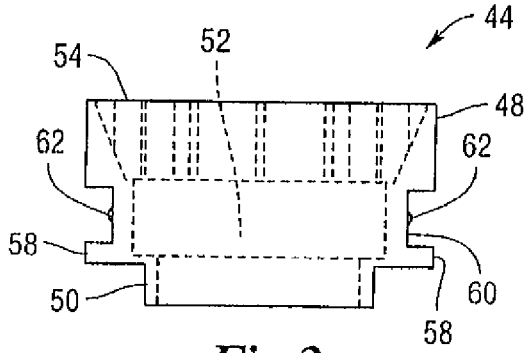
FIG. 2 is a side elevational view of the golf green for a patio of the present invention illustrating the cup, the central passageway of the cup and the projecting dimples of the slots.
Figure 3:
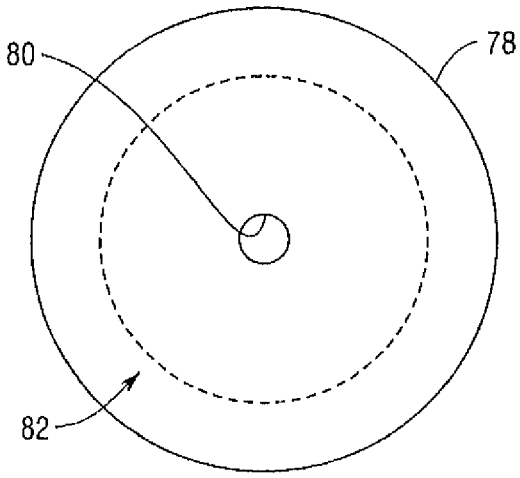
FIG. 3 is a top plan view of the golf green for a patio of the present invention illustrating the cover that is placed over and upon the hole cut in the substrate or supporting surface such as the patio deck.
Figure 7:
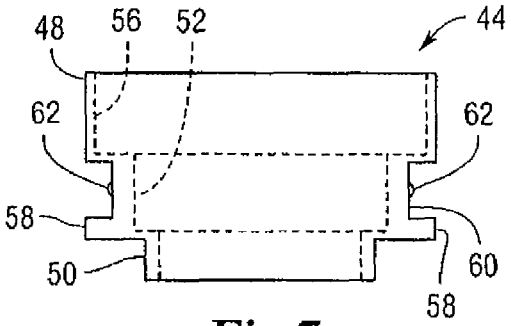
FIG. 7 is a side elevational view of the golf green for a patio of the present invention illustrating an alternative configuration for the cup first shown in FIG. 1 wherein the interior sidewalls are vertical and not beveled.

Illustrated in FIGS. 1, 2, 7, 11 and 18-22 is a cup 44 adapted for slidable removable placement within the cup retaining structure 24 and which receives therein an accurately putted golf ball, such as golf balls 46 and, as hereinafter further described, directs the golf ball 46 to ball collecting structure that is interconnected to the cup 44 that will be hereinafter further described. The cup 44 is generally cylindrical-shaped and includes an upper end 48, a lower end 50, and a centrally located passageway 52 extending therethrough. The cup 44 includes an inner annular upper surface 54 that may be beveled, as shown in FIGS. 1 and 2, or may be vertical 56, as shown in FIG. 7. Adjacent the lower end 50 of the cup 44 are opposed exterior annular projections 58 located 180 degrees from each other with the projections 58 defining opposed slots or grooves 60. The slots 60 are spaced 180 degrees from each other and are parallel to each other. Each slot 60 also includes on its inside flat surface at least one nubbin or dimple 62 and the cup 44 is slid onto the cup retaining structure 24 by aligning the slots 60 with the respective legs 32 and inwardly stepped portions 38 so that the cup 44 can be slid all the back to the bight portion 34 of the cup retaining structure 24 with the curvilinear configuration of the bight portion 34 providing for the contiguous seating of the cylindrical cup 44 thereagainst and in alignment with the golf hole 14 cut into the substrate 12. The dimples 62 provide resistive engagement against the flat vertical surface 64 of each inwardly stepped portion 38 thereby helping to maintain the cup 44 in its seated position on the cup retaining structure 24.

Figure 5:
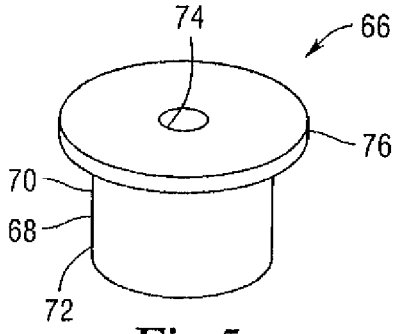
FIG. 5 is a perspective view of the golf green for a patio of the present invention illustrating the plug for placement within the passageway of the cup thereby closing off the cup.
Figure 6:
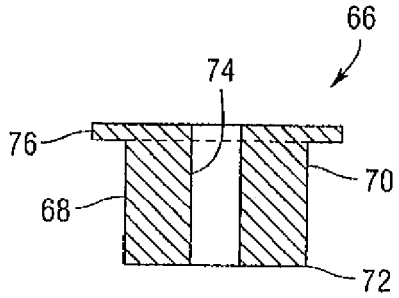
FIG. 6 is a side elevational view of the golf green for a patio of the present invention illustrating the centrally located through hole that extends through the plug and which can accommodate the lower end of the golf flag.
Figure 11:
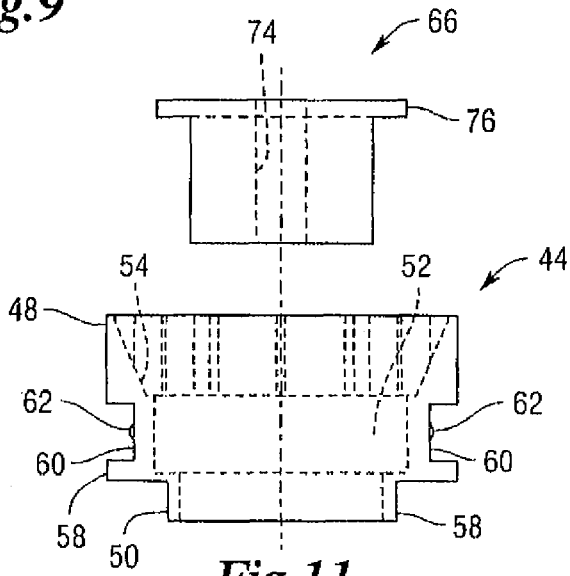
FIG. 11 is a side elevational view of the golf green for a patio of the present invention illustrating the alignment of the plug with the cup.
Figure 12:
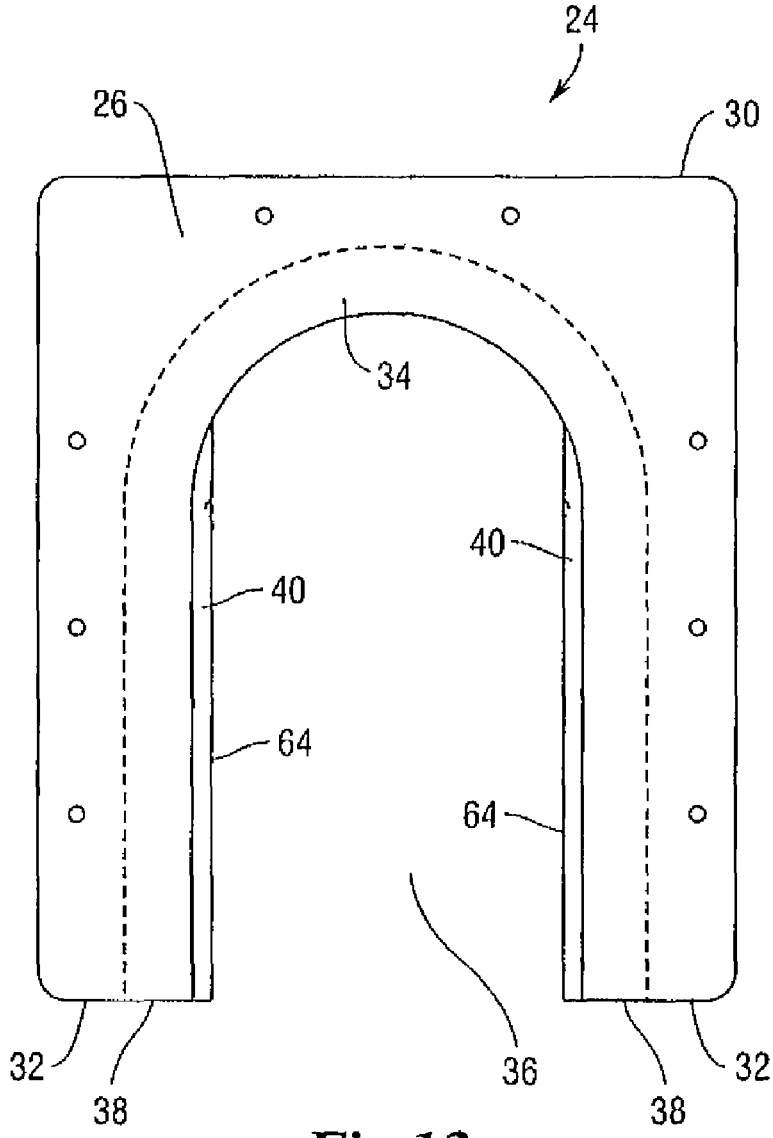
FIG. 12 is a top plan view of the golf green for a patio of the present invention illustrating the cup retaining structure into which the cup slides for being supported therein with the cup retaining structure mounted to the underside of the substrate or supporting surface.

Illustrated in FIGS. 5, 6 and 11 is a plug 66 capable of removable insertion within the passageway 52 of the cup 44 thereby preventing golf balls 46 from falling downward therethrough for collection by ball collection structure hereinafter further described. The cylindrical-shaped plug 66 includes a cylindrical major body portion 68, an upper end 70, an opposite lower end 72, a centrally located through hole 74, and an annular rim or flange 76 adjacent the upper end 70. As shown in FIG. 11, when the plug 66 is placed within the passageway 52 of the cup 44, the rim 76 abuts the inner annular surface 54 or 56 of the cup 44, seats the plug 66 within the cup 44 and thus prevents the plug 66 from falling through the passageway 52 of the cup 44.

Figure 4:
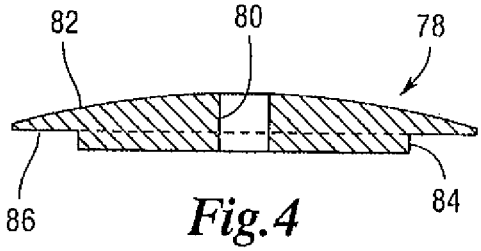
FIG. 4 is a side elevational view of the golf green for a patio of the present invention illustrating the cover and the centrally located aperture into which the bottom of the staff of the golf flag can be inserted.
Figure 8:
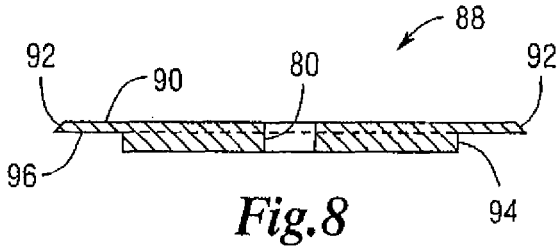
FIG. 8 is a side elevational view of the golf green for a patio of the present invention illustrating an alternative embodiment for the cover first shown in FIG. 4.

Illustrated in FIGS. 3, 4, 8 and 23 are covering means for covering the golf hole 14 when not in use. The covering means is placed over and upon the golf hole 14 when the golf hole 14 is not in use for preventing injury to anyone stepping unawares into the otherwise exposed golf hole 14. The covering means includes several embodiments one of which is shown in FIG. 4 and which is a convex/concave round cover 78 having a centrally located through hole 80 into which the lower end 20 of the staff 22 of the golf flag pole 18 can be inserted and supported. The cover 78 of FIG. 4 includes an upwardly convex surface 82 and a lower inner cylindrical portion 84 having a smaller diameter than the convex portion 82 that seats snugly within the golf ball hole 14 with the outer annular underside 86 of the convex portion 82 resting on the substrate or supporting surface 12 or even the portion of a carpet that is laid over the substrate or supporting surface 12 and surrounds the golf hole 14. FIG. 8 illustrates an alternative embodiment for the cover wherein the cover 88 of FIG. 8 includes a circular disc portion 90 having a flat upper side, a slanted or beveled edge 92 and a lower annular portion 94 whose diameter is less than that of the circular disc portion 90. The lower annular portion 94 fits snugly within the golf ball hole 14 while the underside 96 of the circular disc portion 90 rests on the substrate, supporting surface 12, or the portion of the carpet surrounding the hole 14. For illustrative purposes the cover 78 of FIG. 4 is shown as being placed upon the golf hole 14 completely covering the golf hole 14. Moreover, a pair of fasteners 42 are inserted down through the cover 78 and into the substrate 12 for fixing the cover 78 or 88 in place.

Figure 9:
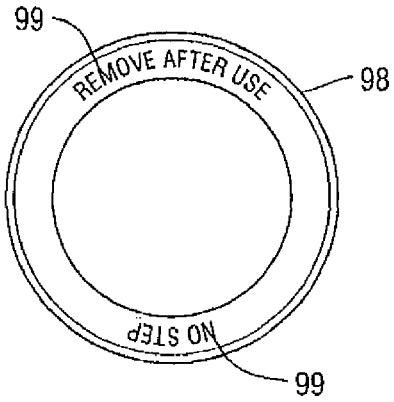
FIG. 9 is a top plan view of the golf green for a patio of the present invention illustrating a ring insert that is placed within the cup to change—reduce—the diameter of the cup.
Figure 10:
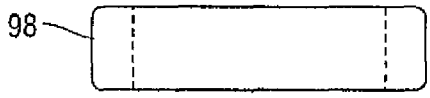
FIG. 10 is a side elevational view of the golf green for a patio of the present invention illustrating the ring insert first shown in FIG. 9 from the side.
Figure 21:
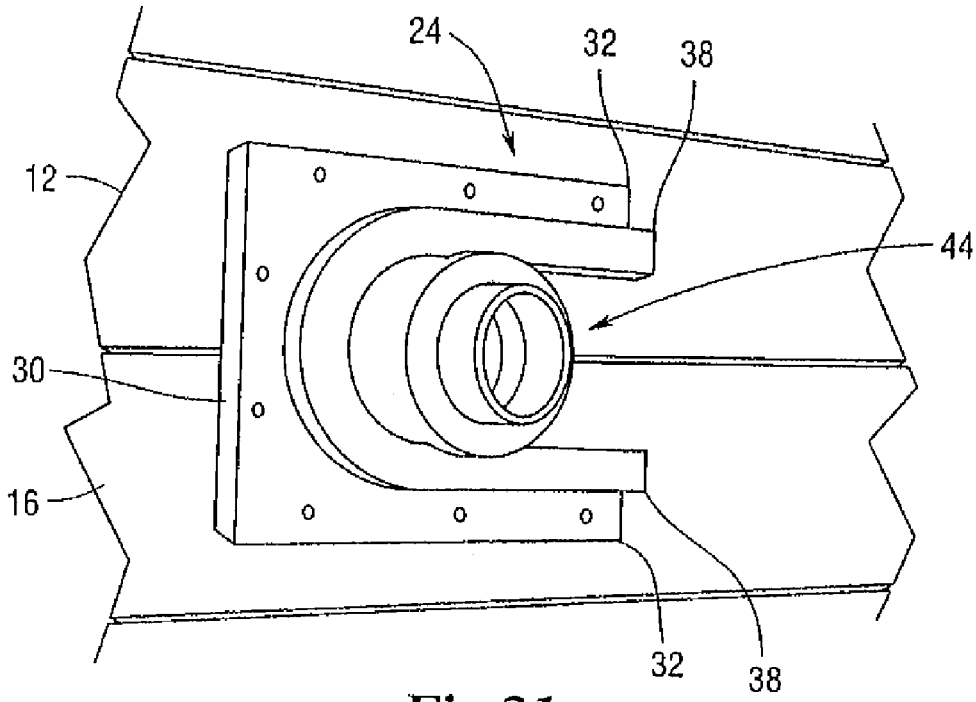
FIG. 21 is a perspective view of the golf green for a patio of the present invention illustrating the securement of the cup retaining structure to the underside of the supporting surface with the cup completely slid onto the cup retaining structure for alignment with the hole cut in the supporting surface.
Figure 23:
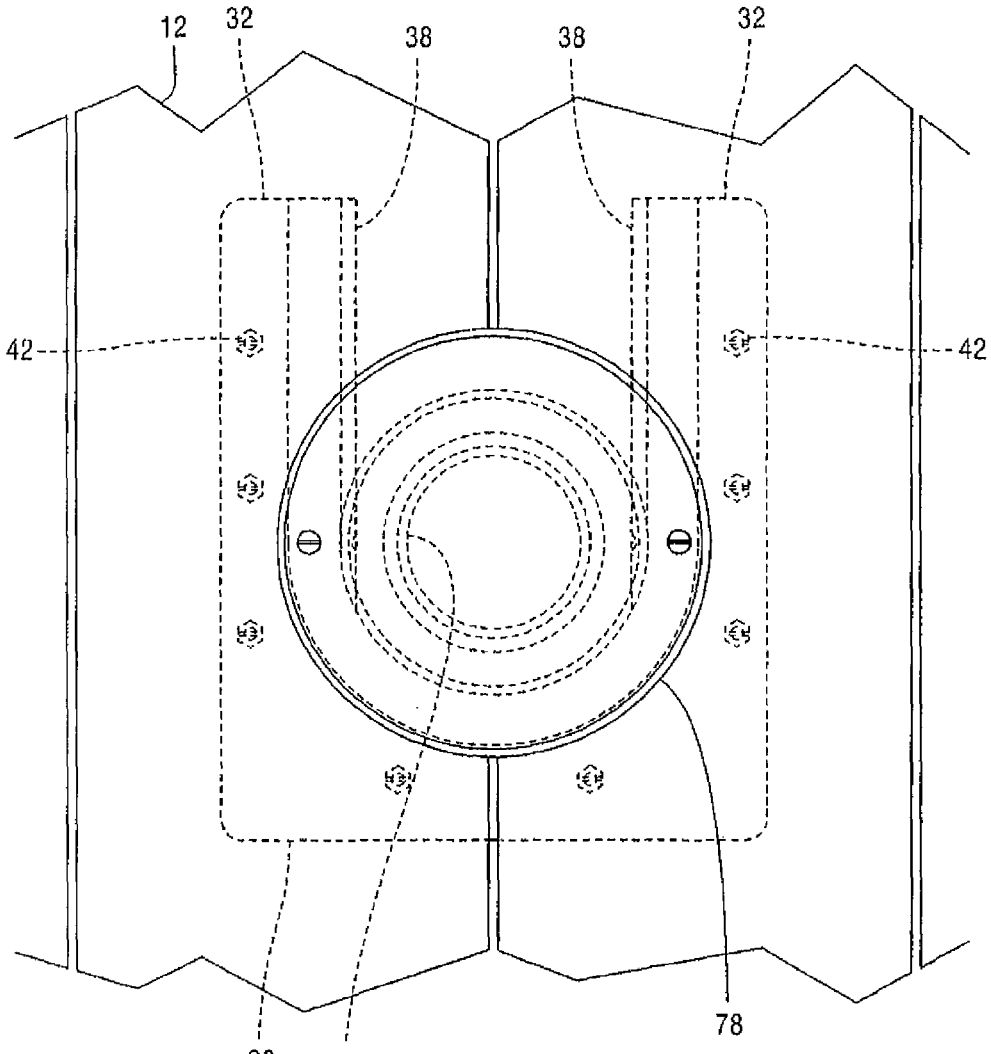
FIG. 23 is a top plan view of the golf green for a patio of the present invention illustrating the securement of the cover to the supporting surface for covering the hole cut in the supporting surface.

Illustrated in FIGS. 9 and 10 is an embodiment for a ring insert 98 that is placed within the inner annular upper surface 54 or 56 of the cup 44, whether that surface is beveled as shown in FIGS. 1, 2 and 11, or vertical as shown in FIG. 7. The ring insert 98 can come in various diameters and is placed within the upper end 48 of the cup 44 to essentially close down and reduce the annular diametrical size of the upper end 48 of the cup 44 thereby increasing the difficulty of putting the golf ball 46 into the cup 44 by reducing the diameter of the cup 44. Ring insert 98 also includes imprinted on its upper surface indicia 99 that indicate how the insert 98 is to be used with representative indicia 99 including the following "Remove After Use No Step." FIG. 21 illustrates the cup retaining structure 24 secured to the underside 16 of the substrate 12 with the cup 44 fully seated and positioned on the cup retaining structure 24 and in alignment with the golf hole 14 while FIG. 23 shows a portion of the cup 44 with the staff 22 of the golf flag 18 inserted into the through hole 74 of the plug 66 (only a portion of the plug 66 is visible in FIG. 23).

Figure 22:
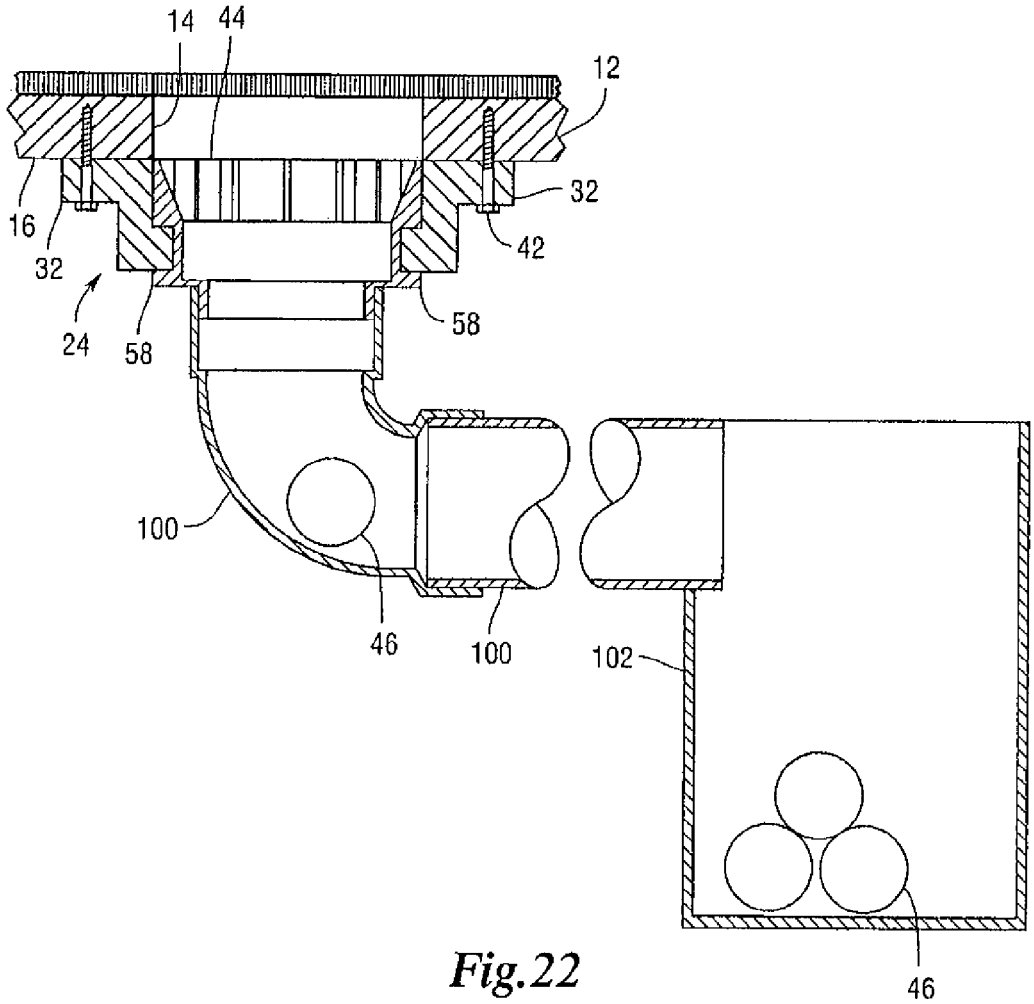
FIG. 22 is a side elevational view of the golf green for a patio of the present invention illustrating the attachment of a ball return and collection system to the lower end of the cup.

FIG. 22 illustrates a ball collection means removably attachable to the lower end 50 of the cup 44 and into and through which the golf ball 46 will travel by gravity whereupon after a number of golf balls 46 have been collected they can be easily retrieved. This allows the individual to practice for a sustained amount of time without having to constantly retrieve the golf ball 46 from the cup 44. The ball collection means includes one or more pieces or segments of conduit or pipe 100 (preferably standard PVC pipe) interconnected one to another and leading to a box or box-like container 102 which serves as the repository for the golf balls 46 and into which the golf balls 46 fall by gravity for collection therein. The conduit segments 100 and the container 102 are mounted to the underside 16 of the substrate 12 by any standard bracket or hanger arrangement and should be mounted in a place easily accessible for the individual.

Figure 13:
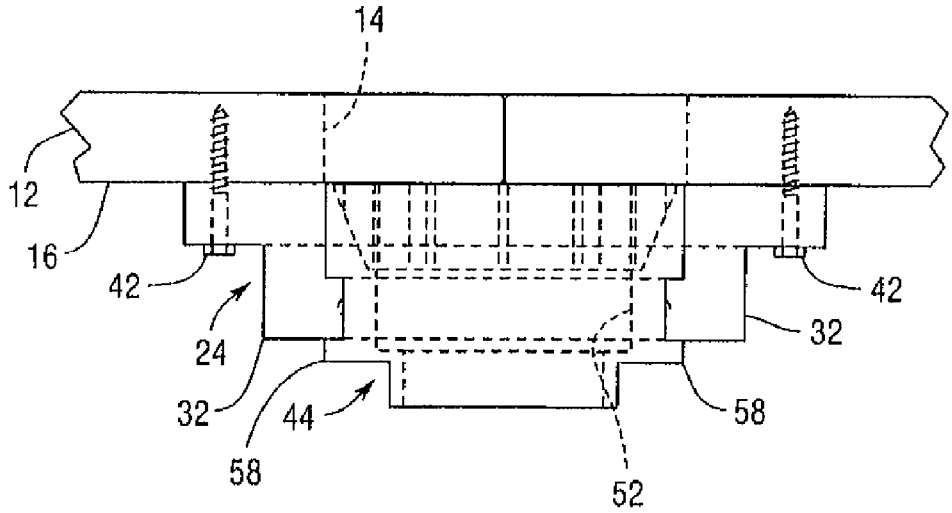
FIG. 13 is a front elevational view of the golf green for a patio of the present invention illustrating the disposition of the cup after it has been slid into the cup retaining structure.
Figure 14:
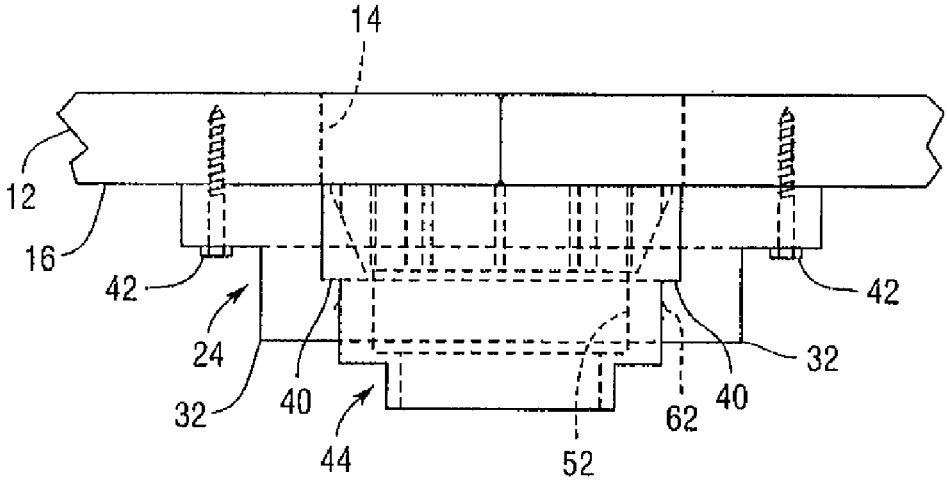
FIG. 14 is a front elevational view of the golf green for a patio of the present invention illustrating the disposition of the cup after it has been slid into the cup retaining structure with the configuration of the lower end of the cup showing an alternative embodiment than the configuration of the cup shown in FIGS. 1, 7, and 13.
Figure 15:
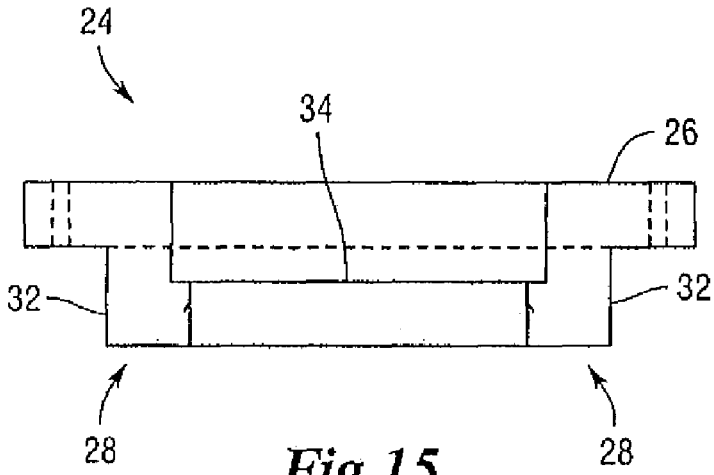
FIG. 15 is a front elevational view of the golf green for a patio of the present invention illustrating cup retaining structure from the open end thereof.
Figure 16:
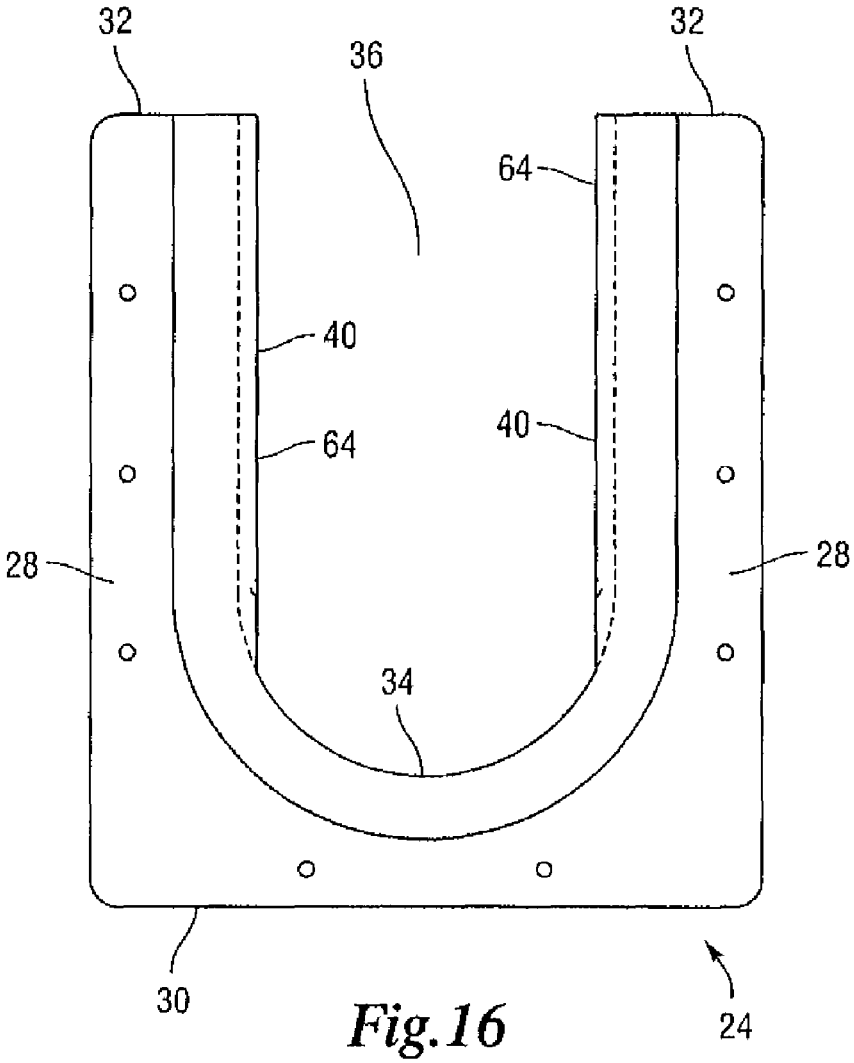
FIG. 16 is a bottom plan view of the golf green for a patio of the present invention illustrating the cup retaining structure from the bottom thereof.
Figure 17:
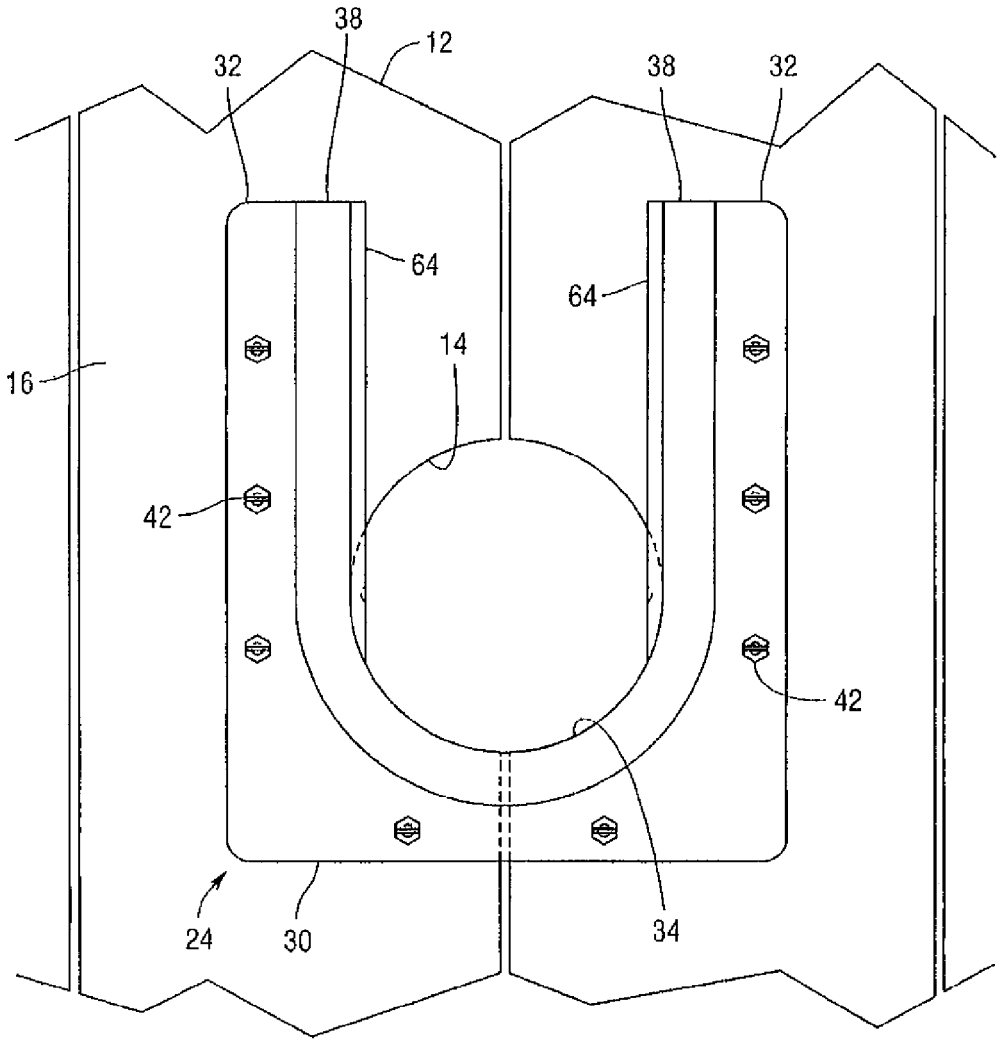
FIG. 17 is a bottom plan view of the golf green for a patio of the present invention illustrating the securement of the cup retaining structure to the underside of the supporting surface and in alignment with the hole cut into the supporting surface.
Figure 18:
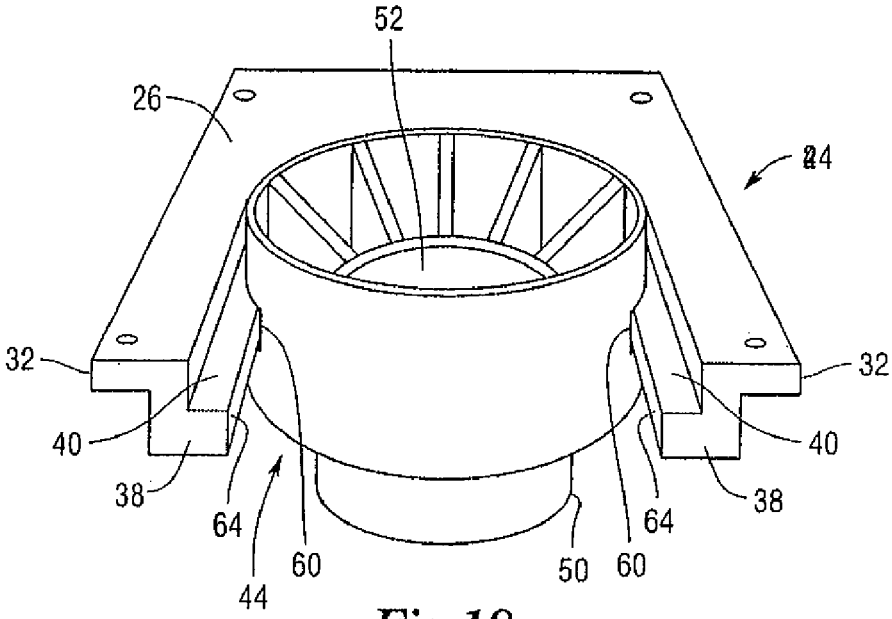
FIG. 18 is a perspective view of the golf green for a patio of the present invention illustrating the seating of the cup on the cup retaining structure.
Figure 19:
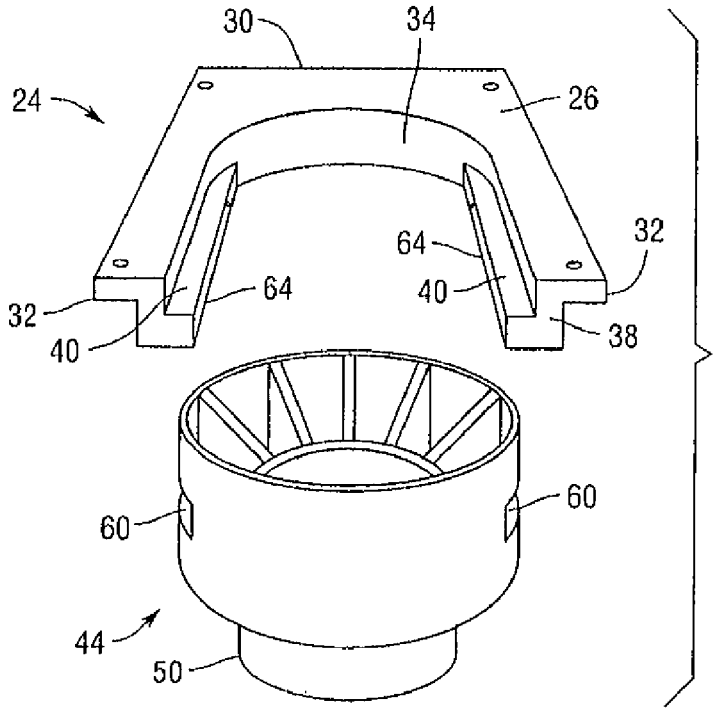
FIG. 19 is a perspective view of the golf green for a patio of the present invention illustrating the alignment of the cup with the cup retaining structure prior to the slideable placement of the cup on the cup retaining structure.
Figure 20:
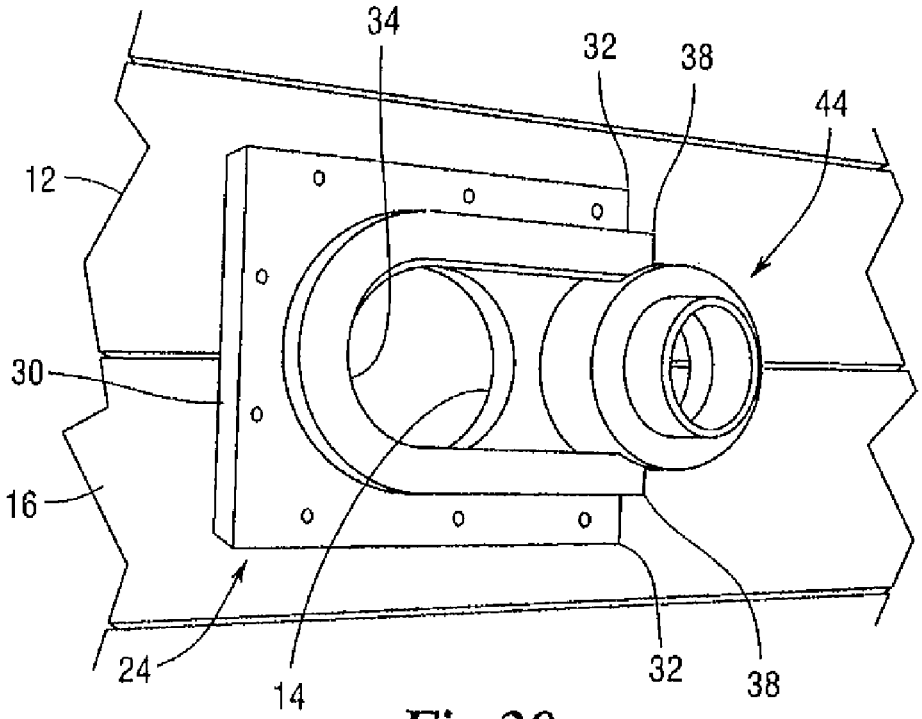
FIG. 20 is a perspective view of the golf green for a patio illustrating the securement of the cup retaining structure to the underside of the supporting surface, such as the patio, and the initial disposition of the cup relative to the cup retaining structure for mounting the cup to the cup retaining structure.
Figure 24:
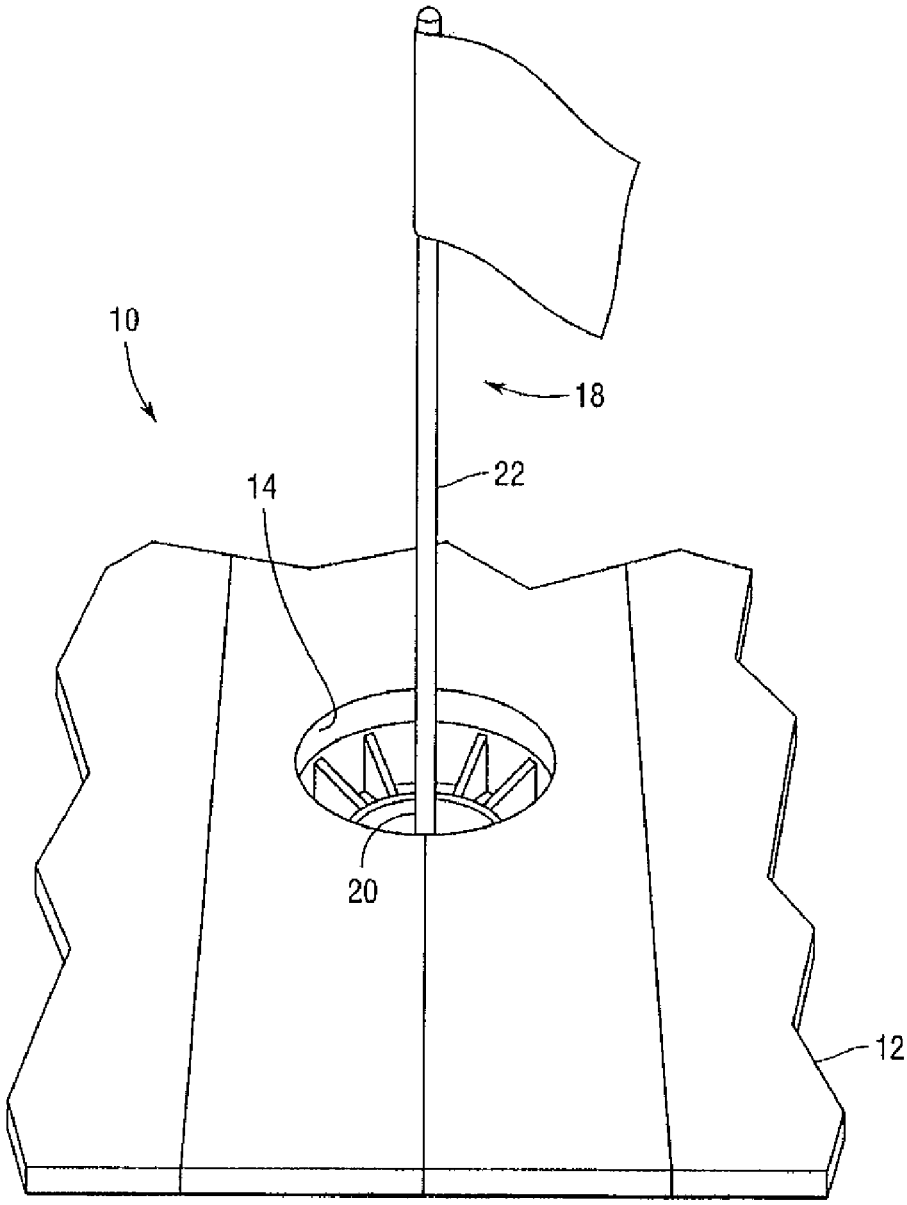
FIG. 24 is a perspective view of the golf green for a patio of the present invention illustrating insertion of the lower end of the staff of the golf flag into the hole for insertion with the through hole of the plug that has been seated within the cup.

FIG. 24 shows a portion of the cup 44 visible through the golf hole 14 formed and cut in the substrate 12 with the lower end 20 of the staff 22 of the golf flagpole 18 being supported in and by the plug 66 (which is not visible). FIGS. 18 and 19 schematically illustrate the cup 44 being initially aligned with the cup retaining structure 24 and then slid backward and seated against the bight portion 34 of the cup retaining structure 24; FIG. 20 illustrates the cup retaining structure 24 mounted to the underside 16 of the substrate 12 with the slots 60 of the cup 44 aligned with the stepped portions 38 of the legs 32 and FIG. 21 shows the cup 44 slid hack to the bight portion 34 for situating the passageway 52 of the cup 44 in axial alignment with the golf hole 14. FIG. 13 illustrates the alignment of the slots 60 with the legs 32 and stepped portions 38 integral with each leg 32 while in FIG. 14 the lower projections 58 that define each slot 60 have been removed but the cup 44 is still able to be aligned with the legs 32 so that the cup 44 can be slid therealong both for easily and quickly seating the cup 44 on the cup retaining structure 24 and also for slidably removing the cup 44 from the cup retaining structure 24 when desired.

Upon given the above disclosure, numerous other features, modifications, variations and alterations will become apparent to those skilled in the art, and such features, modifications, variations alterations are thus considered a part of this invention and to come within the ambit of the following claims.

I claim:

1. A golf game for an indoor and an outdoor substrate with an accessible underside and having a golf hole formed thereon for practicing and playing the game of golf, comprising:

a U-shaped cup retaining structure for mounting to the underside of the substrate with the cup retaining structure including a body portion and a pair of spaced-apart legs integrally formed to and extending transversely from the body portion with the legs parallel to each other and defining an open mouth;

a cup for slidable placement on the legs of the cup retaining structure with the cup having an upper end, a lower end, a passageway extending therethrough, and a pair of exterior slots located 180 degrees opposite of each other;

each slot including at least one dimple;

a plug for removable insertion within the passageway of the cup with the cup including a centrally located through hole and an annular rim with the annular rim seating the plug within the cup and preventing the plug from falling down through the passageway of the cup;

a cover for placement over the golf hole for covering the golf hole when not in use; and the slots of the cup being aligned with and engaging the respective legs so that the cup can be slid upon the legs toward the body portion for seating the cup on the cup retaining structure so that the centrally located passageway of the cup is aligned with the golf hole formed on the substrate.

2. The golf game for an indoor and outdoor substrate of claim 1 wherein the cup retaining structure includes an upper side, an underside and an inner curvilinear bight portion integrally formed on the body portion and commensurate with the cylindrical configuration of the cup so that the cup can be positioned thereagainst.

3. The golf game for an indoor and an outdoor substrate of claim 2 wherein each leg of the cup retaining structure includes an elongated stepped portion integrally formed to each leg and disposed inboard of that respective leg.

4. The golf game for an indoor and an outdoor substrate of claim 3 wherein the cup includes an inner annular upper surface adjacent the upper end of the cup and circumjacent the passageway.

5. The golf game for an indoor and an outdoor substrate of claim 4 wherein the inner annular upper surface is beveled.

6. The golf game for an indoor and an outdoor substrate of claim 5 wherein the inner annular upper surface is vertical.

7. The golf game for an indoor and an outdoor substrate of claim 6 further comprising a golf ball collection means disposed beneath the substrate and removably attachable to the cup for collecting golf balls that pass through the passageway of the cup and are conveyed by gravity to collection in the golf ball collection means.

8. The golf game for an indoor and an outdoor substrate of claim 7 wherein the golf ball collection means includes conduit attachable to the lower end of the cup.

9. The golf game for an indoor and an outdoor substrate of claim 8 wherein the golf ball collection means includes a container interconnected to the conduit and which serves as the repository for the golf balls so that the golf balls can be collected therein and reused by the individual practicing and playing the game of golf.

10. A golf game for a patio and a deck each having an accessible underside and a golf hole formed on the patio and the deck for practicing and playing the game of golf, comprising:

a U-shaped cup retaining structure for mounting to the underside of the deck and the patio with the cup retaining structure including a body portion and a pair of spaced-apart legs formed to and extending transversely from the body portion with the legs parallel to each other and defining an open mouth;

a cylindrical cup for slidable placement on the legs of the cup retaining structure with the cup having an upper end, a lower end, a passageway extending therethrough, and a pair of exterior slots located 180 degrees opposite of each other;

each slot including at least one dimple;

a plug for removable insertion within the passageway of the cup with the cup including a centrally located through hole and an annular rim with the annular rim facilitating the seating of the plug within the cup and preventing the plug from falling through the passageway of the cup;

a cover for placement over the golf hole for covering the golf hole when not in use;

a coif ball collection means disposed beneath the patio and the deck and removably attachable to the cup for collecting golf balls that pass through the passageway of the cup for conveyance by gravity to the golf ball collection means; and the slots of the cup being aligned with and engaging the respective legs so that the cup can be slid upon the legs toward the body portion and thereby seating the cup on the cup retaining structure so that the centrally located passageway of the cup is aligned with the golf hole formed on the deck and on the patio.

11. The golf game for the deck and the patio of claim 10 wherein the cup retaining structure includes an upper side, an underside and an inner curvilinear bight portion integrally formed on the body portion and whose curvilinear configuration corresponds to the cylindrical configuration of the cup so that the cup can be positioned and seated thereagainst.

12. The golf game for the deck and the patio of claim 11 wherein each leg of the cup retaining structure includes an elongated stepped portion having substantially the same length as the respective leg and which is disposed inboard of that respective leg.

13. The golf game for the deck and the patio of claim 12 wherein the cup includes an inner annular upper surface adjacent the upper end of the cup and located circumjacent the passageway of the cup.

14. The golf game for the deck and the patio of claim 13 wherein the golf ball collection means includes conduit attachable to the lower end of the cup and a container interconnected to the cup by the conduit so that golf balls fall through the passageway of the cup for conveyance by gravity to the container for collection therein and retrieval therefrom.

15. A golf game for a supporting surface with an accessible underside and having a golf hole formed on the supporting surface for practicing and playing the game of golf, comprising:

a U-shaped cup retaining structure for mounting to the underside of the supporting surface with the cup retaining structure including a body portion and a pair of spaced-apart legs formed to and extending transversely from the body portion with the legs disposed parallel to each other and defining an open mouth;

a cup for slidable placement on the legs of the cup retaining structure with the cup having an upper end, a lower end, a passageway extending therethrough, and a pair of exterior slots located 180 degrees opposite of each other;

each slot including at least one dimple;

a plug for removable insertion within the passageway of the cup with the cup including a centrally located through hole and an annular rim with the annular rim facilitating the seating of the plug within the cup and preventing the plug from falling through the passageway of the cup; and the slots of the cup being aligned with and brought into engagement with the respective legs so that the cup can be slid upon the legs toward the body portion for seating the cup on the cup retaining structure and the centrally located passageway of the cup being in alignment with the golf hole and the dimples resistively engaging the legs to maintain the position of the cup on the cup retaining structure.

16. The golf game for the supporting surface of claim 15 further comprising a cover for removable placement upon the golf hole for covering the golf hole when not in use.

17. The golf game for the supporting surface of claim 16 further comprising a plurality of ring inserts with each ring insert having a diameter that is different from the diameters of the other ring inserts and the ring inserts placed in the passageway of the cup to close down and reduce the diametrical size of the passageway of the cup.

18. The golf game for the supporting surface of claim 17 wherein the centrally located through hole of the plug receives the lower end of a golf flagpole for supporting the golf flagpole in an upright position.

19. The golf game for the supporting surface of claim 18 further comprising a golf hall collection means disposed beneath the supporting surface and attachable to the cup for collecting golf balls that pass through the passageway of the cup for conveyance by gravity to the golf ball collection means.

20. The golf game for the supporting surface of claim 19 wherein the golf ball collection means includes conduit attachable to the lower end of the cup and a container interconnected to the conduit and which serves as the repository for the golf balls that pass through the passageway of the cup and travel to the container for collection therein and retrieval therefrom.

* * * * *